US009216853B2

(12) United States Patent
Caruso

(10) Patent No.: US 9,216,853 B2
(45) Date of Patent: Dec. 22, 2015

(54) FLEXIBLE BUSHING

(71) Applicant: The GPM Group, LLC, Tonawanda, NY (US)

(72) Inventor: Albert P. Caruso, Tonawanda, NY (US)

(73) Assignee: Avanti U.S.A. Ltd., Tonawanda, NY (US)

( * ) Notice: Subject to any disclaimer, the term of this patent is extended or adjusted under 35 U.S.C. 154(b) by 95 days.

(21) Appl. No.: 14/035,041

(22) Filed: Sep. 24, 2013

(65) Prior Publication Data

US 2015/0084334 A1 Mar. 26, 2015

(51) Int. Cl.
*B65D 83/00* (2006.01)
*B65D 83/28* (2006.01)

(52) U.S. Cl.
CPC ..... *B65D 83/28* (2013.01)

(58) Field of Classification Search
CPC ..... B65D 83/38; B65D 83/205; B65D 83/24; B65D 83/40; B65D 47/121; B65D 83/222; B65D 50/045; B05B 11/3001; B05B 11/3057; B05B 11/3059
USPC ..... 222/394, 402.1, 402.11, 402.12, 222/402.13, 402.14, 153.1, 153.11, 153.13, 222/153.14, 153.01, 182; 384/28, 14, 16, 384/24, 29; 285/322–324
See application file for complete search history.

(56) References Cited

U.S. PATENT DOCUMENTS

| | | | | |
|---|---|---|---|---|
| 2,837,375 | A | 6/1958 | Efford et al. | |
| 2,951,646 | A | 9/1960 | Efford et al. | |
| 3,083,882 | A | 4/1963 | Schmid et al. | |
| 3,178,071 | A | 4/1965 | Gentoso | |
| 3,195,783 | A * | 7/1965 | Crowell | 222/402.13 |
| 3,452,906 | A | 7/1969 | Daniels | |
| 3,491,951 | A | 1/1970 | Knibb | |
| 4,251,032 | A | 2/1981 | Werding | |
| 4,477,001 | A | 10/1984 | Galia | |
| 5,303,853 | A | 4/1994 | Nye | |
| 5,769,283 | A | 6/1998 | Owada et al. | |
| 6,302,302 | B1 * | 10/2001 | Albisetti | 222/153.11 |
| 6,485,180 | B2 * | 11/2002 | Mena | 384/222 |
| 7,708,173 | B2 * | 5/2010 | Bromber | 222/463 |
| 2008/0105643 | A1 * | 5/2008 | Milian et al. | 215/272 |
| 2008/0164285 | A1 * | 7/2008 | Hygema | 222/153.11 |
| 2008/0179347 | A1 * | 7/2008 | Yerby et al. | 222/153.11 |
| 2008/0210710 | A1 * | 9/2008 | Marquardt et al. | 222/153.11 |
| 2009/0050650 | A1 * | 2/2009 | Walters et al. | 222/153.11 |
| 2009/0266845 | A1 * | 10/2009 | Duquet | 222/153.14 |
| 2011/0036414 | A1 | 2/2011 | Paauwe | |

FOREIGN PATENT DOCUMENTS

| | | |
|---|---|---|
| EP | 1338530 A1 | 8/2003 |
| JP | 2008254751 A | 10/2008 |

* cited by examiner

*Primary Examiner* — Lien Ngo
(74) *Attorney, Agent, or Firm* — Simpson & Simpson, PLLC

(57) ABSTRACT

A bushing for insertion into a cylindrical opening is disclosed having a first radius, the bushing comprising a cylindrical base having a top surface, an axial bore through the base, a plurality of walls extending axially from the top surface of the base to a first axial extent and circumscribing the bore, a plurality of locking fingers extending axially from the base and circumscribing the bore alternatingly with the plurality of walls, the plurality of locking fingers extending axially to a second axial extent less than the first axial extent and each locking finger having a tapered outer surface tapering outward from the base, wherein the plurality of locking fingers compress toward the bore when a force is applied to the tapered outer surface. A collar assembly is also disclosed utilizing the bushing to permanently lock the collar to a container such as an aerosol container.

7 Claims, 9 Drawing Sheets

FLEXIBLE BUSHING

TECHNICAL FIELD

The invention relates generally to a bushing, and more specifically to a bushing that locks into a position to prohibit movement.

BACKGROUND

Bushings are generally a cylindrical lining inserted into a cylindrical opening in order to limit the size of the opening, reduce friction and wear within the opening, provide a bearing surface, or guide motion.

U.S. Pat. No. 3,178,071 (Gentoso) describes a cap assembly using a bearing surface to permanently attach to an aerosol container. The cap has an inner lip created from an upwardly and inwardly extending portion of the cap material. The inner lip has two diametrically opposing slits and an annular shoulder lining the inner surface of the inner lip between the diametrically opposing slits. When attaching the cap to the aerosol container, the slits enable the resilient material of the inner lip to expand around a closure member that was fixedly secured to the neck of the container previously. Once the cap has been pushed onto the container to a certain extent, the inner lip contracts back into its original unexpanded position and the shoulder on the lip springs into a locking position beneath the bottom surface of the closure member. Unfortunately, such a cap assembly requires that the cap itself be manipulated and pressed onto the aerosol container. This is cumbersome and it increases the risk of unintentionally actuating the container since the top of the cap engages the stem of the aerosol container.

An example of a bushing that guides motion is found in U.S. Pat. No. 4,477,001 (Galia). The disclosed pressurized valve system uses a bushing to open and close a valve. A user presses on a platform to a linear extent and the valve opens to a greater linear extent with the aid of the bushing. The bushing has arms of looped material that connect to a central rod. The linear movement for pressing the platform is translated into a rotational movement by radially expanding the looped arms, which in turn translates the rotational movement back into a linear movement for the central rod. However, such a bushing is not configured to restrict axial motion or to lock in place.

Therefore, there has been a long-felt need for a bushing to expand into a locking position and permanently prohibit motion.

SUMMARY

The present invention broadly comprises a bushing having a base having a top surface; an axial bore through the base, a wall extending axially from the top surface of the base and circumscribing at least a portion of the axial bore, the wall extending to a first axial extent from the base, and a flexible locking finger extending axially from the base and circumscribing a portion of the axial bore, the locking finger having a second axial extent from the base less than the first axial extent and a tapered outer surface tapering outward from the base, wherein the flexible locking finger compresses toward the bore when a force is applied to the tapered outer surface.

The present invention also comprises a bushing for insertion into a cylindrical opening is having a first radius, the bushing comprising a cylindrical base having a top surface, an axial bore through the base, a plurality of walls extending axially from the top surface of the base to a first axial extent and circumscribing the bore, a plurality of locking fingers extending axially from the base and circumscribing the bore alternatingly with the plurality of walls, the plurality of locking fingers extending axially to a second axial extent less than the first axial extent and each locking finger having a tapered outer surface tapering outward from the base, wherein the plurality of locking fingers compress toward the bore when a force is applied to the tapered outer surface.

The present invention also comprises a collar assembly for a container, the assembly comprising: a bushing having a base having a first top surface, an axial bore through the base, a wall extending axially from the first top surface and circumscribing at least a portion of the axial bore, the wall extending to a first axial extent from the base and having a first outer surface, and a flexible locking finger extending axially from the base and circumscribing a portion of the axial bore, the locking finger having a second axial extent from the base less than the first axial extent, a tapered outer surface tapering outward from the base, and a second top surface; and, a collar having an opening to receive the bushing, a shelf having an inner surface and a bottom surface, the shelf extending into the opening, wherein the shelf compresses the flexible locking finger toward the bore when the bushing is inserted into the opening due to the tapered outer surface, and the flexible locking finger expands underneath the shelf such that the second top surface abuts the bottom surface of the shelf, while the first outer surface of the wall remains contained within the inner surface due to the first axial extent.

A general object of the present invention is to provide a bushing that can be efficiently installed to permanently lock into place.

Another object of the present invention is to provide a collar assembly for a container that is easily assembled.

These and other objects, advantages and features of the present invention will be better appreciated by those having ordinary skill in the art in view of the following detailed description of the invention in view of the drawings.

BRIEF DESCRIPTION OF THE DRAWINGS

The nature and mode of operation of the present invention will now be more fully described in the following detailed description of the invention taken with the accompanying figures, in which.

DETAILED DESCRIPTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
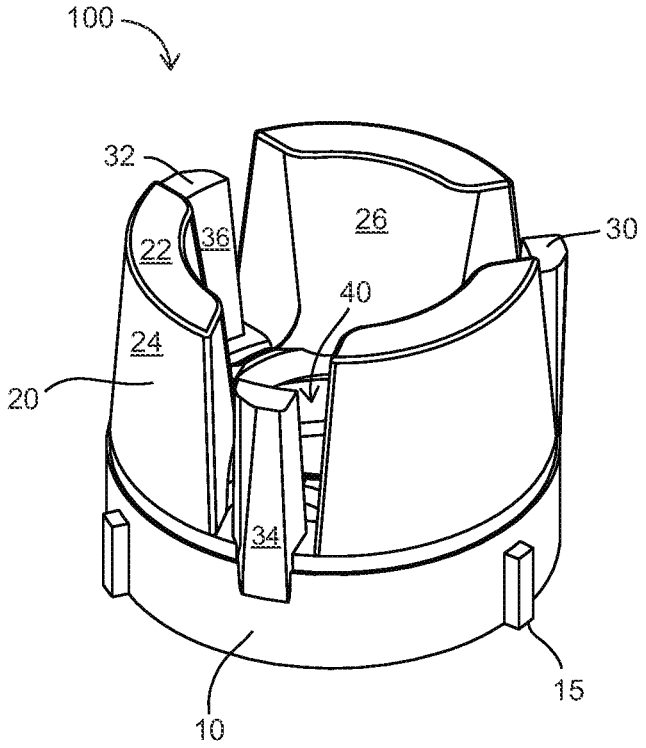
FIG. 1 is a perspective view of a bushing as an example embodiment of the present invention.

FIG. 1 is a perspective view of bushing 100. In a preferred embodiment, bushing 100 has a plurality of circumferentially curved walls 20 alternating with locking fingers 30 around axial through-bore 40. Both walls 20 and fingers 30 extend axially from cylindrical base 10 with top surfaces 22 of walls 20 extending axially beyond top surfaces 32 of fingers 30. Top surfaces 22 act as suitable bearing surfaces within a valve or opening in which it has been installed. Also, outer surfaces 34 of fingers 30 taper radially beyond outer surfaces 24 of walls 20. Further, fingers 30 have inner surfaces 36 that extend radially beyond inner surfaces 26 of walls 20. Bushing 100 is made of a resilient material, for example bendable resilient plastic that is sufficiently stiff to be form-retaining, in order to allow fingers 30 to be flexibly compressed toward bore 40 when bushing 100 is inserted into a cylindrical valve or housing. The significance of the radial and axial differences between walls 20 and fingers 30 will be described in detail with reference to FIGS. 2 and 10.

Still referring to FIG. 1, bushing 100 also has a plurality of locator ribs 15 that radially extend from base 10 and are circumferentially displaced from one another. Ribs 15 are configured to align bushing 100 in a position to properly interact with its surroundings. The significance of the locator ribs will be described in detail with reference to FIGS. 6 and 7.

Figure 2:
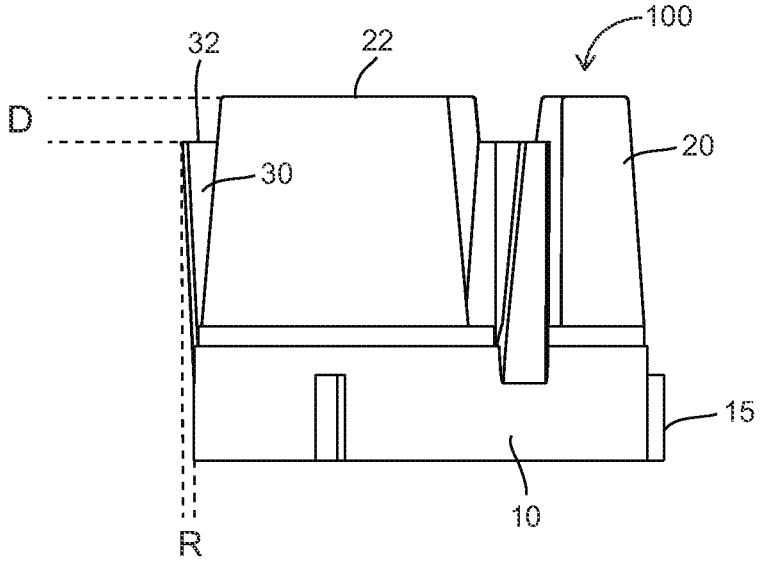
FIG. 2 is a lateral view of a bushing as an example embodiment of the present invention.

FIG. 2 is a lateral view of bushing 100 demonstrating axial difference D between walls 20 and locking fingers 30, and radial difference R between locking fingers 30 and base 10. The tapered outer walls 34 of locking fingers 30 are acted on by a cylindrical valve or opening having a radius comparable to base 10 when a user presses on one or more of top surfaces 22 of walls 20 to insert bushing 100. When bushing 100 is being pushed in a direction with base 10 leading, locking fingers 30 are sufficiently flexible to be compressed radially inward in order to fit into a cylindrical valve or opening. Fingers 30 spring back radially outward once there is sufficient radial room for fingers 30 to do so. This is demonstrated in FIG. 10.

Figure 3:
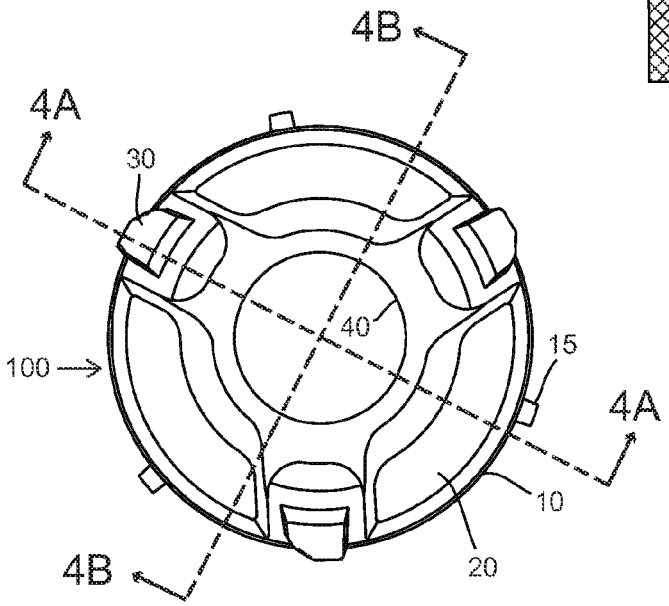
FIG. 3 is a top view of a bushing as an example embodiment of the present invention.

FIG. 3 is a top view of bushing 100 showing locator ribs 15 radially extending from base 10, and locking fingers 30 extending radially beyond base 10. Walls 20 circumscribe bore 40 alternating with locking fingers 30. Walls 20 are circumferentially and radially thicker than locking fingers 30 enabling top surfaces 22 to be suitable bearing surfaces.

Figure 4A:
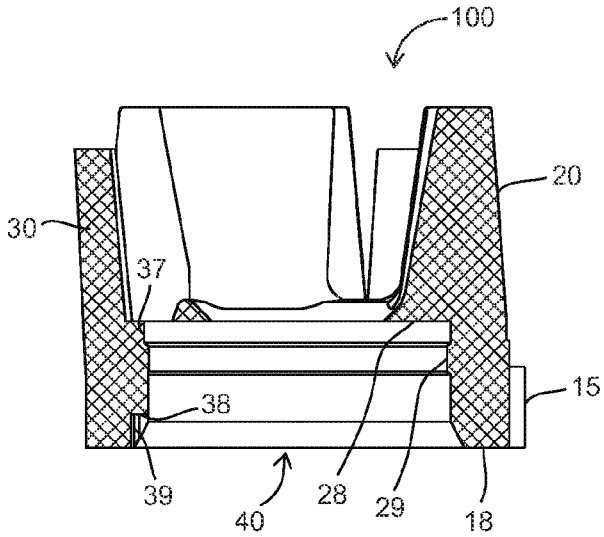
FIG. 4A is a cross-sectional view of the bushing shown in FIG. 3 taken along line 4A-4A.

FIG. 4A is a cross-sectional view of bushing 100 taken along line 4A-4A in FIG. 3 showing that bore 40 may provide a plurality of inner circumferential surfaces 29, 37 and 39 having varying radii in order to accommodate different applications. Preferably, bore 40 is adapted to receive the stem of an aerosol container. The greater radial thickness of wall 20 is demonstrated by inner circumferential surface 37 because wall 20 has bottom surface 28 extending radially inward from surface 37 while finger 30 has no analogous bottom surface. Inner surface 39 is only present axially below finger 30, which provides bottom surface 38.

Figure 4B:
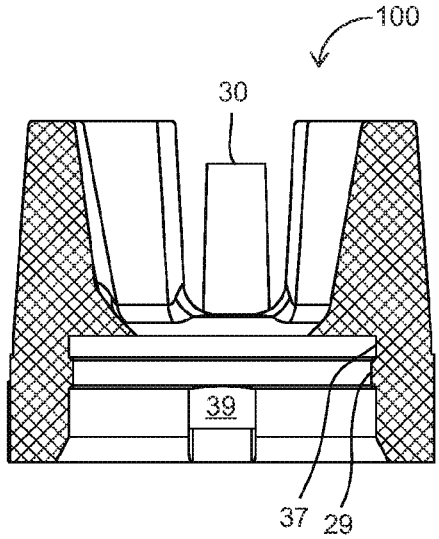
FIG. 4B is a cross-sectional view of the bushing shown in FIG. 3 taken along line 4B-4B.

FIG. 4B is a cross-sectional view of bushing 100 taken along line 4B-4B in FIG. 3 better illustrating inner surface 39 axially below finger 30.

Figure 5:
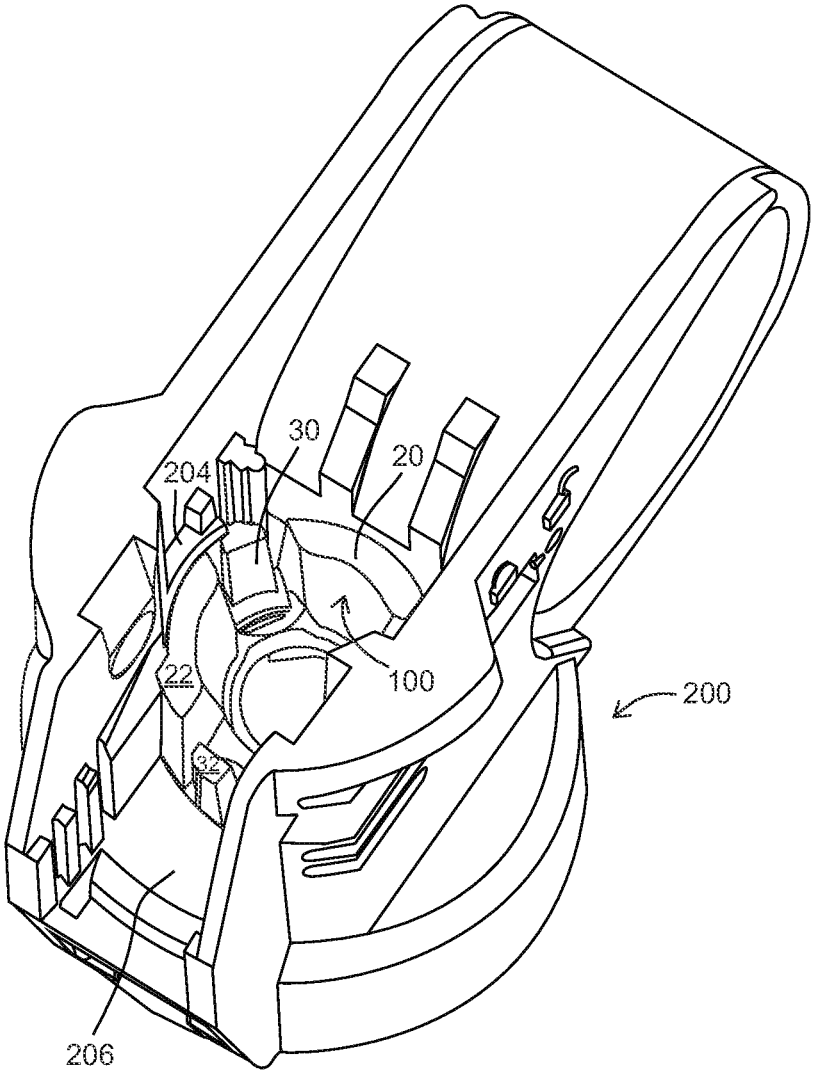
FIG. 5 is a perspective view of a collar assembly as an example embodiment of the present invention with a bushing in an uninstalled position.

FIG. 5 is a perspective view of an example embodiment in context with collar 200 for an aerosol canister. Bushing 100 is in an uninstalled position, meaning bushing 100 has not been pushed downward to permanently lock collar 200 to an aerosol canister. In the uninstalled position, bushing 100 is resting in collar 200 with top surfaces 32 of locking fingers 30 above top surface 206 of shelf 230 (labeled in FIG. 10). Top surfaces 22 of walls 20 are also above top surface 206 of shelf 230. However, walls 20 are contained within collar 200 by shelf 204. As will be seen in FIGS. 6 and 7, locator ribs 15 are below shelf 230.

For proper installation of bushing 100 into collar 200, bushing 100 must have one of locking fingers 30 facing the front of collar 200 before bushing 100 can be being slid into place and lock. This is due to collar 200 having a plurality of receptors positioned within the cylindrical opening to allow locking fingers 30 to snap outward into. The receptors within the cylindrical opening can be configured in any circumferential pattern and bushing 100 can be manufactured to have locking fingers 30 in a corresponding configuration. For example, two or four or more locking fingers can be used if a cylindrical opening or housing has two or four or more receptors positioned to receive the locking fingers. In the example embodiment shown in FIG. 5, a receptor is arranged at the front of collar 200, so one of locking fingers 30 must be properly positioned to face the front of collar 200.

Figure 6:
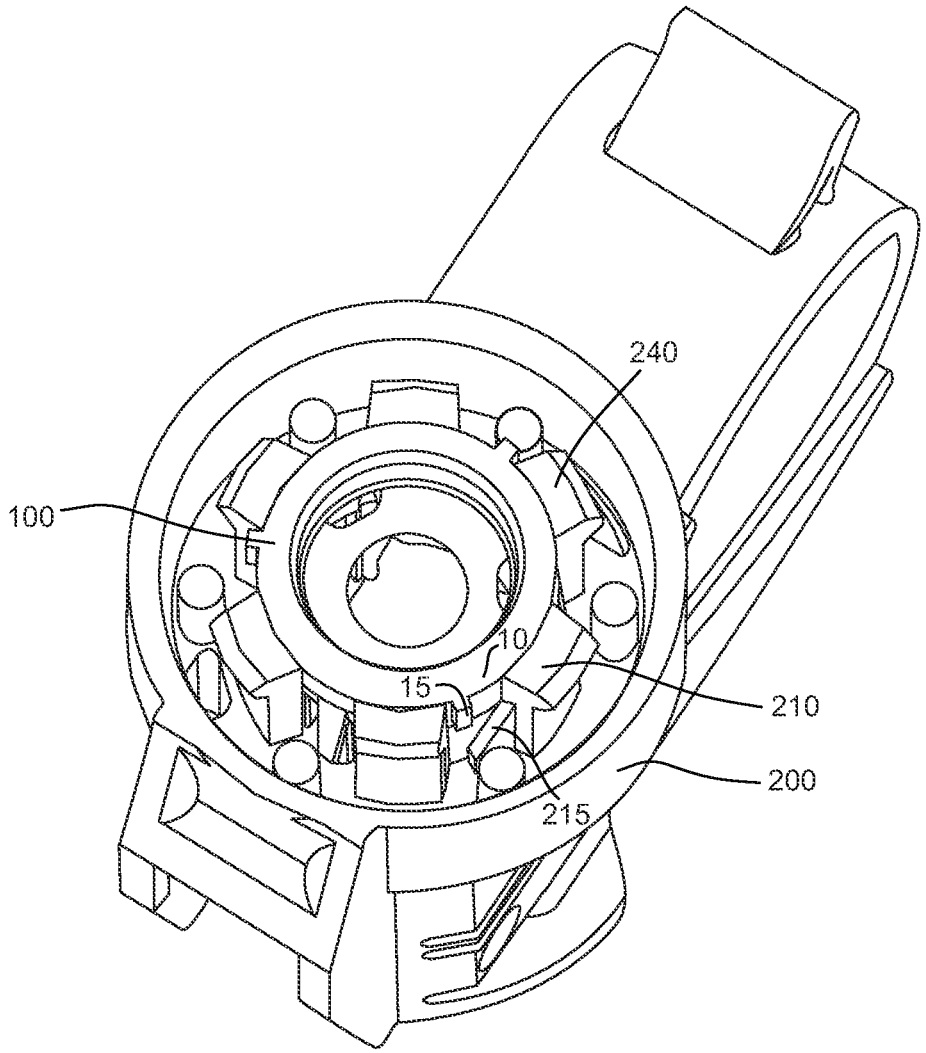
FIG. 6 is a bottom perspective view of a collar assembly as an example embodiment of the present invention.

FIG. 6 is a bottom perspective view of an example embodiment with bushing 100 not properly aligned. To ensure that bushing 100 is in the correct orientation for proper installation, the underside of collar 200 has legs 240 that have circumferential slopes 215 acting as guides for locator ribs 15 extending from base 10. Legs 240 have bottom surfaces 210 that engage the top of a canister. During manufacture, bushing 100 is inserted into the uninstalled position by a machine as part of a bushing collar assembly with locator ribs 15 below collar 200. Locator ribs 15 slide along slopes 215 into the position shown in FIG. 7.

Figure 7:
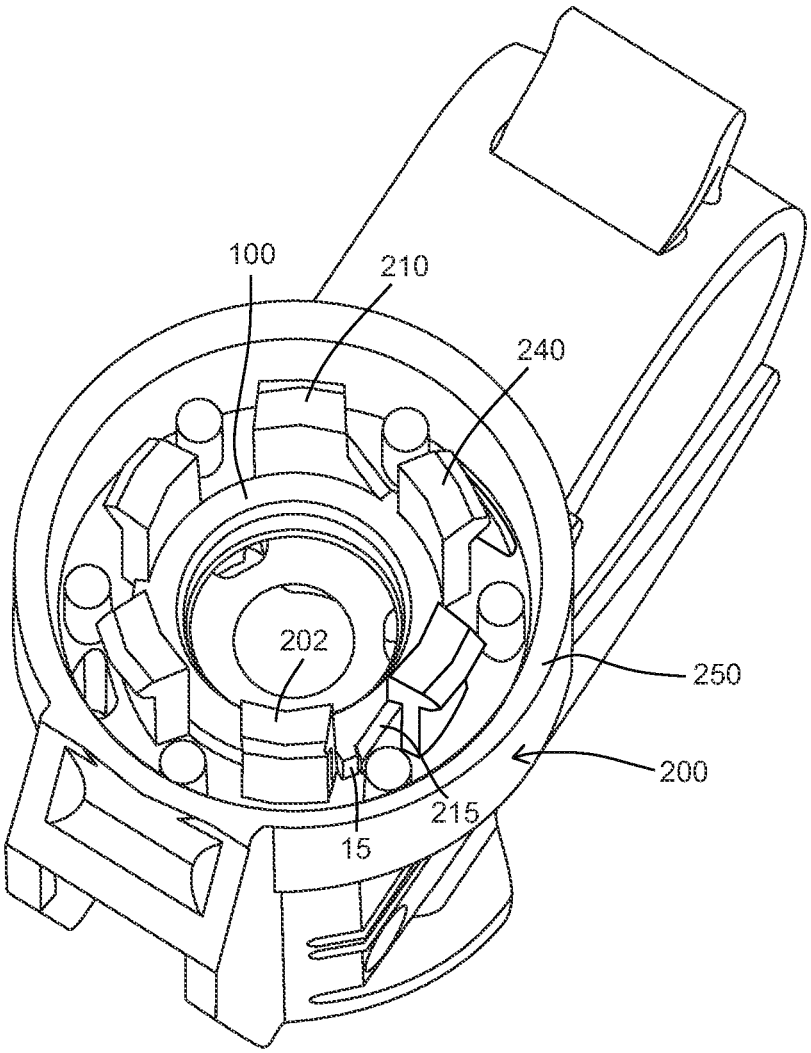
FIG. 7 is a bottom perspective view of a collar assembly with a bushing in a properly aligned position for installation.

FIG. 7 is a bottom perspective view of the example embodiment shown in FIG. 5 with bushing 100 properly aligned with collar 200. In the properly aligned position, locator ribs 15 are positioned between slopes 215 and abutment walls 202. Collar 200 is in a position to be installed onto a canister with collar edge 250 encompassing the top rim of the canister.

Figure 8:
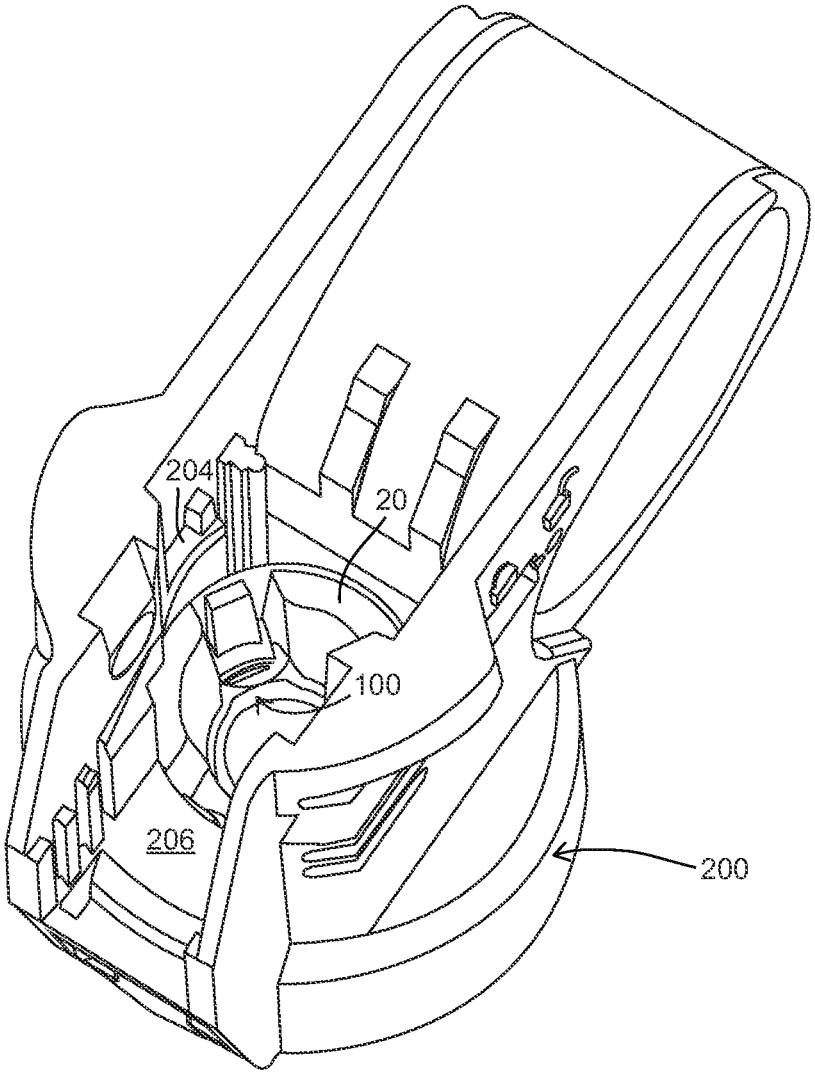
FIG. 8 is a perspective view of a collar assembly with a bushing in the installed position.

FIG. 8 illustrates bushing 100 pushed into collar 200 in the locked position, thereby permanently locking collar 200 to an aerosol canister. In this position, top surfaces 22 of walls 20 are below top surface 206 of collar 200.

Figure 9:
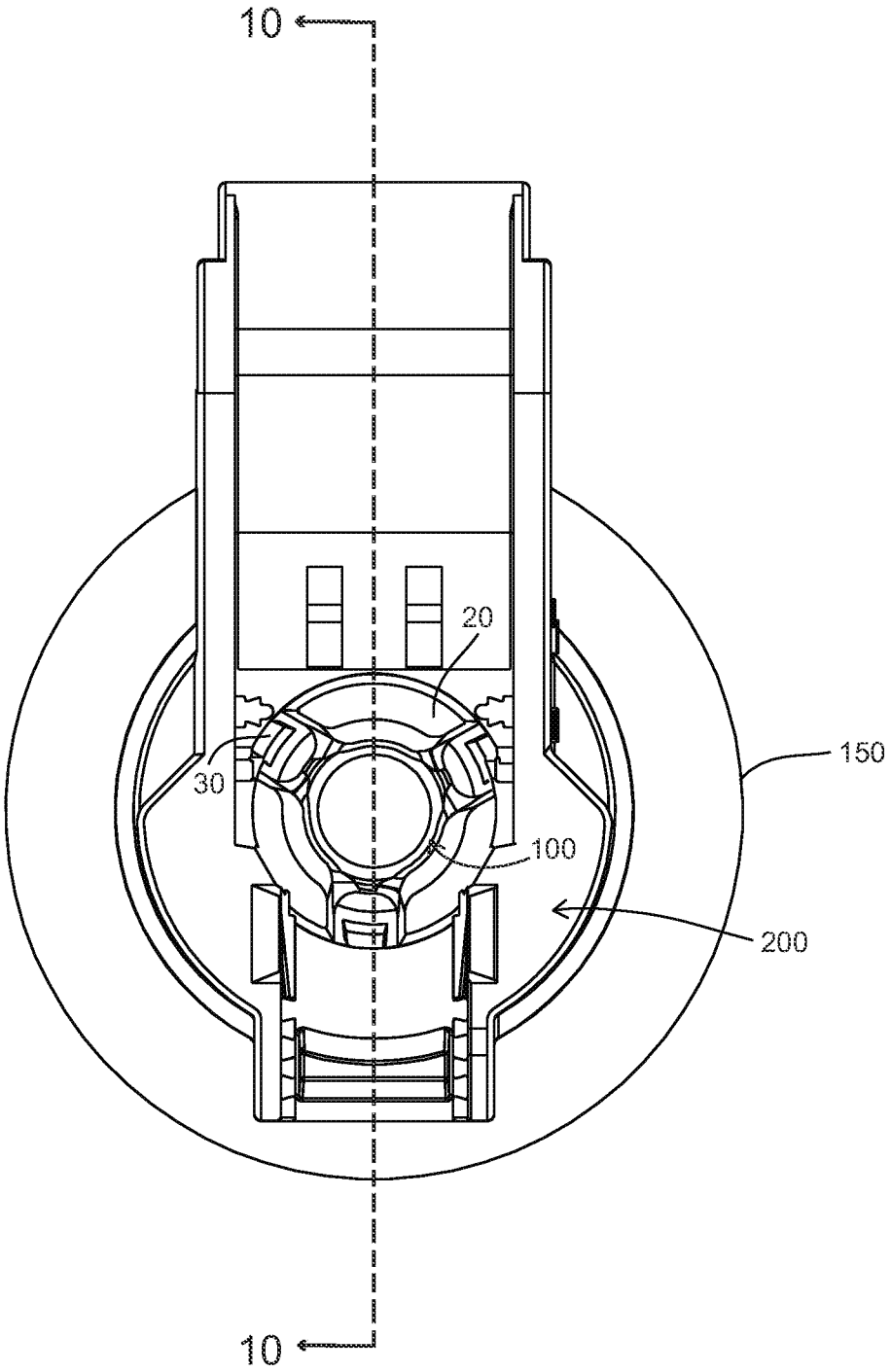
FIG. 9 is a top view of a collar assembly installed onto a container.

FIG. 9 is a top view of collar 200 permanently locked to canister 150 with bushing 100 in a locked position.

Figure 10:
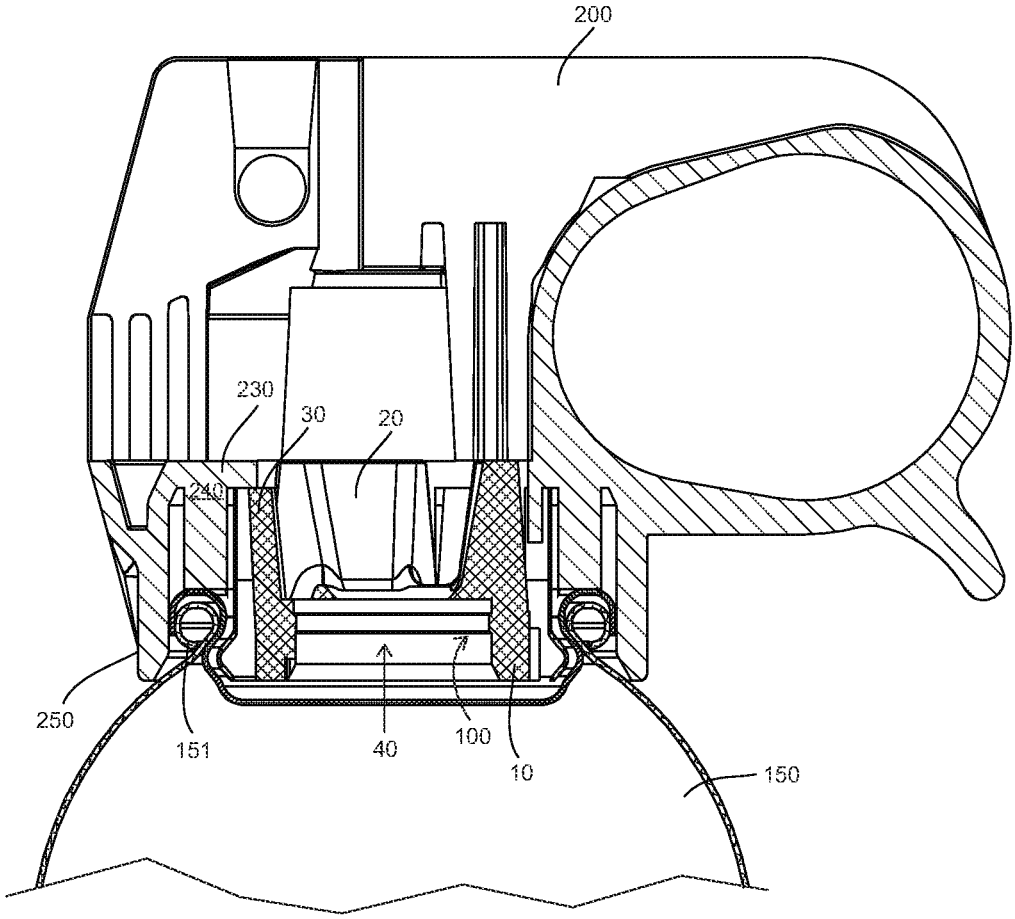
FIG. 10 is a cross-sectional view of the configuration shown in FIG. 9 taken along line 10-10; and, FIG. 11 is a perspective view of an aerosol actuator installed with a collar and bushing on an aerosol canister.

FIG. 10 is a cross-sectional view of the configuration shown in FIG. 9 taken along line 10-10. When installed, bushing 100 engages collar 200 and canister 150 such that the collar and bushing assembly cannot be removed from the canister. Collar 200 generally comprises a cylindrical opening or housing configured to receive bushing 100 with a radius comparable to base 10 and wall segments 20. However, base 10 and wall segments 20 may have different radii as long as they can still perform their respective purposes. When a user pushes bushing 100 down into the collar opening with the base 10 as the leading end, locking fingers 30 are squeezed inward to fit into the collar opening because fingers 30 (due to their radial tapering) have a larger radius than shelf 230 of collar 200. Due to radial difference R (labeled in FIG. 2) and axial difference D (labeled in FIG. 2) between fingers 30 and walls 20, when bushing 100 is inserted to a certain extent, fingers 30 snap back to their original radially outward positions underneath shelf 230 while walls 20 are still housed within the radius of shelf 230. With the locking fingers back in their original positions, the bushing can no longer be removed up and out of the collar because top surfaces 32 of locking fingers 30 abut the underside of shelf 230.

Fingers 30 of bushing 100 expand into a locking position, which is also a relaxed position for fingers 30. Bushing 100 is locked into place with respect to collar 200 by fingers 30 extending underneath shelf 230 of collar 200. In an example embodiment, shelf 230 of collar 200 is created by receptors circumferentially displaced around the cylindrical housing of collar 200. In an example embodiment, shelf 230 is continuous around the entire circumference of the cylindrical housing of collar 200. If shelf 230 is continuous around the entire circumference, it is conceivable that locator ribs 15 and sloped surfaces 215 may not be required.

Bore 40 of bushing 100 is configured to receive the stem of canister 150 with base 10 proximate canister 150 and walls 20 distal to canister 150. As a result, bushing 100 is sandwiched between canister 150 and collar 200 thereby locking everything in place. Collar 200 is attached to canister 150 by snapping collar edge 250 around rim 151 of canister 150 to a point where bottom surfaces 210 (labeled in FIG. 6) of abutment wall 240 abut the top of rim 151.

Figure 11:
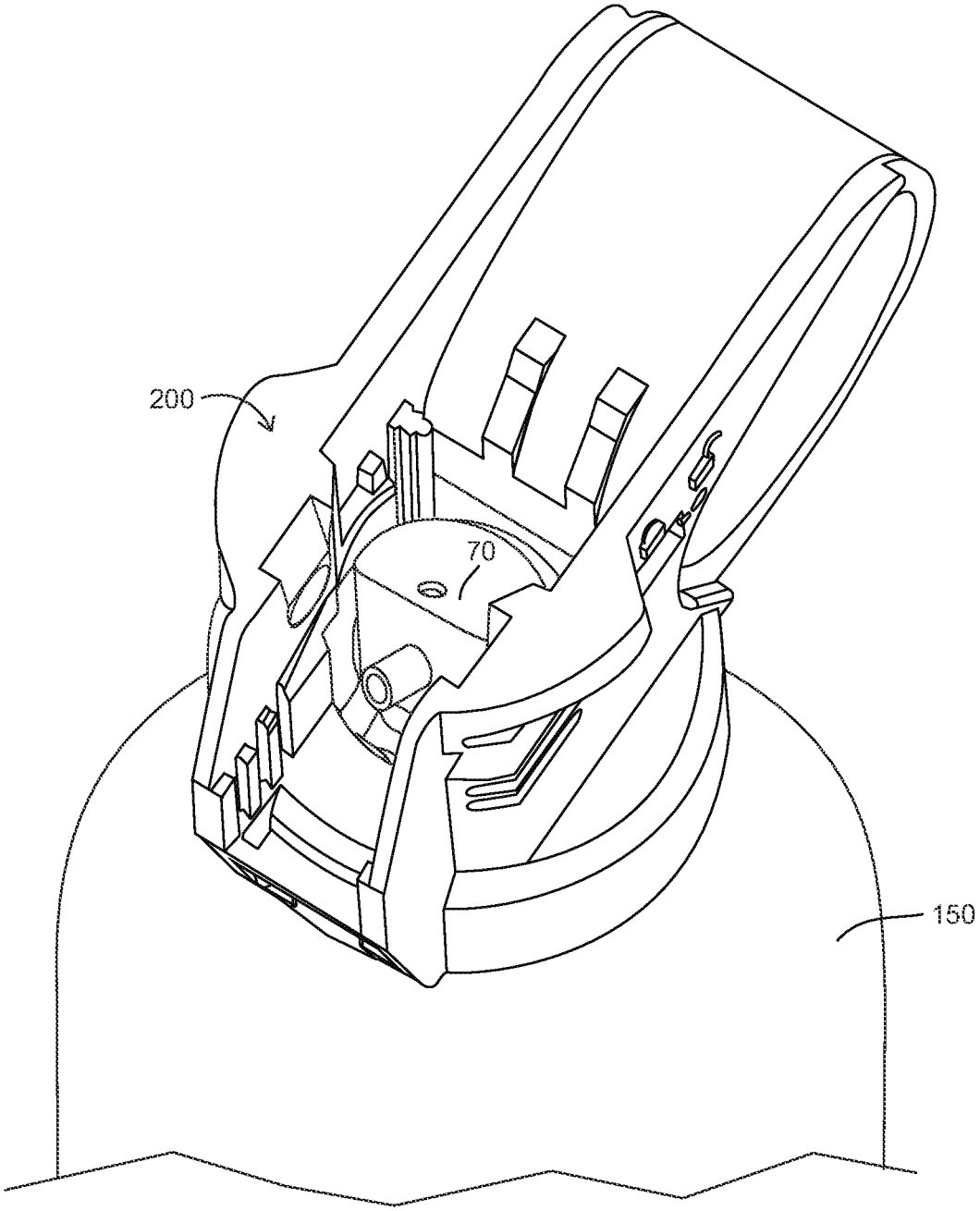

FIG. 11 illustrates collar 200 permanently installed onto container 150 and provides context as to where an example actuator 70 may be installed.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention as claimed.

What is claimed is:

1. A bushing, comprising: a base having a top surface; an axial bore through the base; a wall extending axially from the top surface of the base and circumscribing at least a portion of the axial bore, the wall extending to a first axial extent from the base; and, a flexible locking finger extending axially and radially outward from the base and circumscribing a portion of the axial bore, the locking finger having a second axial extent from the base less than the first axial extent and a tapered outer surface tapering outward from the base; wherein the flexible locking finger compresses toward the bore when a force is applied to the tapered outer surface; and wherein the axial bore is adapted to receive a stem of an aerosol container.

2. The bushing recited in claim 1, further comprising a locator rib radially extending from the base.

3. A bushing for insertion into a cylindrical opening having a first radius, the bushing comprising:

a cylindrical base having a top surface;

an axial bore through the base;

a plurality of walls extending axially from the top surface of the base to a first axial extent and circumscribing the bore; and, a plurality of locking fingers extending axially from the base and circumscribing the bore alternatingly with the plurality of walls, the plurality of locking fingers extending axially to a second axial extent less than the first axial extent and each locking finger having a tapered outer surface tapering outward from the base;

wherein the plurality of locking fingers compress toward the bore when a force is applied to the tapered outer surface; and wherein the axial bore is adapted to receive a stem of an aerosol container.

4. The bushing recited in claim 3, further comprising a locator rib radially extending from the base.

5. A collar assembly for a container, the assembly comprising:

a bushing having:

a base having a first top surface; an axial bore through the base; a wall extending axially from the first top surface and circumscribing at least a portion of the axial bore, the wall extending to a first axial extent from the base and having a first outer surface; and, a flexible locking finger extending axially from the base and circumscribing a portion of the axial bore, the locking finger having a second axial extent from the base less than the first axial extent, a tapered outer surface tapering outward from the base, and a second top surface; and, a collar having:

an opening to receive the bushing;

a shelf having an inner surface and a bottom surface, the shelf extending into the opening;

wherein the shelf compresses the flexible locking finger toward the bore when the bushing is inserted into the opening due to the tapered outer surface, and the flexible locking finger expands underneath the shelf such that the second top surface abuts the bottom surface of the shelf, while the first outer surface of the wall remains contained within the inner surface due to the first axial extent; and wherein the collar has a bottom edge adapted to receive an aerosol container and the axial bore of the bushing is adapted to receive a stem of the aerosol container.

6. The assembly recited in claim 5, wherein:

the bushing further comprises a locator rib radially extending from the base: and, the collar further comprises a second bottom surface and a circumferentially sloped surface on the bottom surface;

wherein the bushing is properly oriented within the housing of the collar by the circumferentially sloped surface guiding the locator rib.

7. The bushing of claim 1, wherein the wall extends axially away from the base.

* * * * *